US007295085B2

(12) United States Patent
Face

(10) Patent No.: US 7,295,085 B2
(45) Date of Patent: Nov. 13, 2007

(54) PROCESS FOR MAKING HIGH TEMPERATURE SUPERCONDUCTOR DEVICES EACH HAVING A LINE ORIENTED IN A SPIRAL FASHION

(75) Inventor: Dean W. Face, Wilmington, DE (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 94 days.

(21) Appl. No.: 10/909,696

(22) Filed: Aug. 2, 2004

(65) Prior Publication Data

US 2005/0143263 A1 Jun. 30, 2005

Related U.S. Application Data

(60) Provisional application No. 60/496,849, filed on Aug. 21, 2003.

(51) Int. Cl.
*H01P 1/203* (2006.01)
*H01P 1/20* (2006.01)

(52) U.S. Cl. ..... 333/99 S; 333/185; 333/204; 505/210; 505/238

(58) Field of Classification Search ..... 333/185, 333/204, 99 S; 505/210, 238
See application file for complete search history.

(56) References Cited

U.S. PATENT DOCUMENTS 3,373,348 A 3/1968 Vanier et al.
3,764,892 A 10/1973 Rollwitz
4,027,768 A * 6/1977 Riessen ..... 198/360
4,514,691 A 4/1985 De Los Santos et al.
5,036,279 A 7/1991 Jonsen
5,135,908 A 8/1992 Yang et al.
5,206,592 A 4/1993 Buess et al.
5,233,300 A 8/1993 Buess et al.
5,258,710 A 11/1993 Black et al.
5,262,394 A 11/1993 Wu et al.
5,276,398 A 1/1994 Withers et al.
5,351,007 A 9/1994 Withers et al.
5,418,213 A * 5/1995 Tanaka et al. ..... 505/329
5,457,385 A 10/1995 Sydney et al.
5,583,437 A 12/1996 Smith et al.
5,585,723 A 12/1996 Withers
5,592,083 A 1/1997 Magnuson et al.
5,594,338 A 1/1997 Magnuson
5,656,937 A 8/1997 Cantor
5,661,400 A 8/1997 Plies et al.

(Continued)

FOREIGN PATENT DOCUMENTS

EP 0 426 851 5/1991

(Continued)

OTHER PUBLICATIONS

Miller, et al., "Performance of a High-Temperature Superconducting Probe for In Vivo Microscopy at 2.0 T", Magnetic Resonance in Medicine, (1999) pp. 72-79, vol. 41.

(Continued)

*Primary Examiner*—Benny Lee
*Assistant Examiner*—Kimberly E Glenn

(57) ABSTRACT

A process for producing high temperature superconductor (HTS) mini-filters or coils in which the high temperature superconductor films are deposited on a layer of $CeO_2$ on a substrate results in higher yields of mini-filters or coils.

4 Claims, 3 Drawing Sheets

U.S. PATENT DOCUMENTS 5,750,473 A 5/1998 Shen
5,751,146 A 5/1998 Hrovat
5,804,967 A 9/1998 Miller et al.
5,814,987 A 9/1998 Smith et al.
5,814,989 A 9/1998 Smith et al.
5,814,992 A 9/1998 Busse-Grawitz et al.
5,872,080 A * 2/1999 Arendt et al. ..... 505/238
5,952,269 A 9/1999 Ma et al.
5,973,495 A 10/1999 Mansfield
5,986,455 A 11/1999 Magnuson
5,999,000 A 12/1999 Srinivasan
6,025,719 A 2/2000 Anderson
6,054,856 A 4/2000 Garroway et al.
6,088,423 A 7/2000 Krug et al.
6,091,240 A 7/2000 Smith et al.
6,104,190 A 8/2000 Buess et al.
6,108,569 A * 8/2000 Shen ..... 505/210
6,150,816 A 11/2000 Srinivasan
6,166,541 A 12/2000 Smith et al.
6,169,399 B1 1/2001 Zhang et al.
6,194,898 B1 2/2001 Magnuson et al.
6,201,392 B1 3/2001 Anderson et al.
6,218,943 B1 4/2001 Ellenbogen
6,242,918 B1 6/2001 Miller et al.
6,291,994 B1 9/2001 Kim et al.
6,335,622 B1 1/2002 James et al.
6,370,404 B1 4/2002 Shen
D459,245 S 6/2002 Power
6,420,872 B1 7/2002 Garroway et al.
6,486,838 B1 11/2002 Smith et al.
6,538,445 B2 3/2003 James et al.
6,541,966 B1 4/2003 Keene
6,556,013 B2 4/2003 Withers
6,566,873 B1 5/2003 Smith et al.
6,590,394 B2 7/2003 Wong et al.
6,617,591 B1 9/2003 Simonson et al.
6,653,917 B2 * 11/2003 Kang et al. ..... 333/99 S
6,751,489 B2 6/2004 Shen
6,751,847 B1 6/2004 Brey et al.
6,777,937 B1 8/2004 Miller et al.
6,819,109 B2 11/2004 Sowers et al.
6,822,444 B2 11/2004 Lai
6,847,208 B1 1/2005 Crowley et al.
6,952,163 B2 10/2005 Muey et al.
6,956,476 B2 10/2005 Buess et al.
6,958,608 B2 10/2005 Takagi et al.
7,049,814 B2 5/2006 Mann
7,106,058 B2 9/2006 Wilker et al.
2002/0068682 A1 6/2002 Shen
2002/0153861 A1 10/2002 Smith et al.
2002/0156362 A1 10/2002 Bock et al.
2002/0169374 A1 11/2002 Jevtic
2002/0190715 A1 12/2002 Marek
2003/0020553 A1 1/2003 Gao et al.
2003/0062896 A1 4/2003 Wong et al.
2003/0071619 A1 4/2003 Sauer et al.
2003/0119677 A1 6/2003 Qlyan et al.
2003/0136920 A1 7/2003 Flores et al.
2004/0124840 A1 7/2004 Reykowski
2004/0222790 A1 11/2004 Karmi et al.
2004/0251902 A1 12/2004 Takagi et al.
2005/0104593 A1 5/2005 Laubacher et al.
2005/0122109 A1 6/2005 Wilker et al.
2005/0140371 A1 6/2005 Alvarez et al.
2005/0146331 A1 7/2005 Flexman et al.
2005/0206382 A1 9/2005 Laubacher et al.
2005/0248345 A1 11/2005 Alvarez
2005/0258831 A1 11/2005 Alvarez
2005/0264289 A1 12/2005 Alavarez
2005/0270028 A1 12/2005 Alvarez et al.
2006/0012371 A1 1/2006 Laubacher et al.
2006/0038563 A1 2/2006 Cisholm et al.
2006/0082368 A1 4/2006 McCambridge
2006/0119360 A1 6/2006 Yamamoto et al.

FOREIGN PATENT DOCUMENTS

EP 1 168 483 1/2000
EP 1 122 550 A1 8/2001
EP 1 416 291 5/2004
EP 1 477 823 A 11/2004
GB 2 286 248 8/1995
GB 2 289 344 11/1995
JP 05 269108 10/1993
JP 07 265278 10/1995
WO WO 92/17793 10/1992
WO WO 92/17794 10/1992
WO WO 92/19978 11/1992
WO WO 92/21989 12/1992
WO WO 94/05022 3/1994
WO WO 95/34096 12/1995
WO WO 96/39636 12/1996
WO WO 96/39638 12/1996
WO WO 98/37438 8/1998
WO WO 98/54590 12/1998
WO WO 99/45409 9/1999
WO WO 99/50689 10/1999
WO WO 00/70356 11/2000
WO WO 02/082115 A2 10/2002
WO WO 02/098364 12/2002
WO WO 03/014700 2/2003
WO WO 03/040761 5/2003
WO WO 03/096041 11/2003
WO WO 04/001454 A1 12/2003
WO WO 04/102596 11/2004
WO WO 05/059582 A1 6/2005

OTHER PUBLICATIONS

W.H. Wong, et al., "HTS Coils for High Resolution Nuclear Magnetic Resonance Spectroscopy", Advances in Cryogenic Engineering, (1996), pp. 953-959, New York.

V. Kotsubo et al., "Cryogenic System for a High Temperature Superconductor NMR Probe", Advances in Cryogenic Engineering, Jul. 17, 1995, vol. 41, pp. 1857-1864, New York.

Kushida, et al., "Dependence on the Pure Quadrupole Resonance Frequency on Pressure and Temperature", Physical Review, (Dec. 1956), pp. 1364-1377, vol. 104, No. 5, Massachusetts.

Vanier, "Temperature Dependence of the Pure Nuclear Quadrupole Resonance Frequency in KC103", Canadian Journal of Physics, (Nov. 1960), pp. 1397-1405, vol. 38, No. 11, Canada.

Smith, et al., "Nitrogen Electric Quadrupole and Proton Magnetic Resonances in Thiourea", Journal of Chemical Physics, (Oct. 1964), pp. 2403-2416, vol. 41, No. 8, New York.

Turner, C.W., High Temperature superconductor circuit components for cryogenic microwave systems, Electrical and Computer Engineeting, 1993, Canadian Conference on Vancouver, BC Canada (Sep. 14-17, 1993) XP 010118071.

W. A. Edelstein et al., A signal-to-noise calibration procedure for NMR imaging systems, Medical Physics, vol. 11 (2) Mar./Apr. 1984, pp. 180-185.

Hirschfeld, et al., "Short Range Remote NQR Measurements", Journal of Molecular Structure, 1980, pp. 63-77, vol. 58, The Netherlands.

Garroway, et al., "Remote Sensing By Nuclear Quadrupole Resonance", IEEE Transactions on Geoscience and Remote Sensing, Jun. 2001, pp. 1108-1118, vol. 39, No. 6.

Garroway, et al., "Narcotics and Explosives Detection by 14N pure NQR", SPIE, 1993, pp. 318-327, vol. 2092, Maryland.

Charles Wilker, "HTS Sensors for NQR Spectroscopy", vol. 1, pp. 143-146, 2004.

Anders Stensgaard, "Optimized Design of the Shielded-Loop Resonator", Journal of Magnetic Resonance, 122, 120-126 (1996), Article No. 0187.

He, D.F. et al., "Metal detector based on high-Tc RF SQUID", Physica C 378-381 (2002) pp. 1404-1407.
Withers, R.S. et al., "Thin-Film HTD Probe Coils For Magnetic-Resonance Imaging", IEEE Transactions On Applied Superconductivity, vol. 3, pp. 2450-2453, Mar. 1993.
Hill Howard, D.W. et al., "Improved Sensitivity Of NMR Spectroscopy Probes By Use Of High-Temperature Superconductive Detection Coils", IEEE Transactions On Applied Superconductivity, vol. 7, pp. 3750-3753, Jun. 1997.
Black, R.D. et al., "Performance Of A High-Temperature Superconducting Resonator For High-Field Imaging", Journal Of Magnetic Resonance, pp. 74-80 (1995).
Black, R.D. et al., "A High-Temperature Superconducting Receiver For Nuclear Magnetic Resonance Microscopy", Science, vol. 259, pp. 793-795 Feb. 5, 1993.
P.B. Romer, "The NMR Phased Array", Magnetic Resonance in Medicine 16, 192-225 (1990).
Bendall, et. al., "Elimination of Coupling between Cylindrical Transmit Coils and Surface-Receive Calls for In Vivo NMR" Magnetic Resonance in Medicine v3 p. 157-163, 1986.
Colton, et. al., "Making the World a Safer Place", Science, v.299, I.5611, Pgd. 1324-1325, Frb. 2006.
Fisher, et al., "A Versatile Computer-Controlled Pulsed Nuclear Quadrupole Resonance Spectrometer", Review of Scientific Instruments, v70, No. 12, p. 4678, Dec. 1999.
Landers, et al., "Electronic Effects and Molecular Motion in β-Octahydro-1,3,5,7-tetranitro-1,3,5,7-tetrazocine Bases on $^{14}N$ Nuclear Quadrupole Resonance Spectroscopy", American Chemical Society, *J. Phys. Chem.*, 85, pp. 2618-2623, 1981.
Karpowicz, et. al., "Librational Motion of Hexahydro-1,3,5-trinitro-s-triazine Based on the Temperature Dependence of the Nitrogen-14 Nuclear Quadrupole Resoneance Spectra: The Relationship to Condensed-Phase Thermal Decomposition", American Chemical Society, *J. Phys. Chem.* 87, pp. 2109-2112, 1983.
Volpicelli, et. al., "locked rf Spectrometer for Nuclear Quadrupole Resonance", The Review of Scientific Instruments, v.25, No. 2, pp. 150-153, Feb. 1965.
Benedek, et. al., "Precise Nuclear Resonance Thermometer", The Review of Scientific Instruments, v.28, No. 2, pp. 92-95, Feb. 1957.
Ernst, "Magnetic Resonance with Stochastic Excitation", Journal of Magnetic Resonance 3, pp. 10-27, 1970.
Klainer, et. al., "Fourier Transform Nuclear Quadrupole Resonance Spectroscopy", Fourier, Hadamard, and Hillbert Transforms in Chemistry, pp. 147-182, 1982.

* cited by examiner

PROCESS FOR MAKING HIGH TEMPERATURE SUPERCONDUCTOR DEVICES EACH HAVING A LINE ORIENTED IN A SPIRAL FASHION

This application claims the benefit of U.S. Provisional Application No. 60/496,849, filed Aug. 21, 2003, which is incorporated in its entirety as a part hereof for all purposes.

FIELD OF THE INVENTION

This invention relates to high temperature superconductor (HTS) mini-filters comprised of self-resonant spiral resonators and HTS coils and the improvement in the process yield of such mini-filters and coils when they are produced using high temperature superconductor films deposited on a layer of $CeO_2$ on a substrate.

BACKGROUND OF THE INVENTION

HTS filters have many applications in telecommunication, instrumentation and military equipment. The HTS filters have the advantages of extremely low in-band insertion loss, high off-band rejection and steep skirts due to the extremely low loss in the HTS materials. In one design, the HTS filters are comprised of spiral resonators that are large in size. In fact, at least one dimension of the resonator is equal to approximately a half wavelength. For low frequency HTS filters with many poles, the regular design requires a very large substrate area. The use of self-resonant spiral resonators to reduce the size of the HTS filters and solve cross-talk and connection problems reduces the size of the substrate area required. Nevertheless, the substrates of thin film HTS circuits are special single crystal dielectric materials that have a high cost. The HTS thin film coated substrates are even more costly. The mini-filter design must then be created on the HTS film typically using photoresist and ion etching techniques. The final cost is significant and it is commercially important to have a high yield of mini-filters that meet specifications.

HTS coils have applications as transmit, receive, and transmit and receive coils for electromagnetic signals. Producing these HTS coils requires the same steps that are used in producing the HTS filters. The related costs are also similar so that it is important to have a high yield of HTS coils that meet specifications.

U.S. Pat. No. 5,262,394 discloses a ceramic superconductor comprising a metal oxide substrate, a ceramic high temperature superconductive material, and an intermediate layer of a material having a cubic crystal structure. There nevertheless remains a need for a process for producing in high yield mini-filters and coils that meet required specifications, and the mini-filters and coils so produced.

An object of the present invention is to therefore provide a process for producing in high yield mini-filters and coils that meet required specifications.

SUMMARY OF THE INVENTION

This invention provides a high temperature superconductor mini-filter comprised of at least two self-resonant spiral resonators, each of the spiral resonators independently comprising a high temperature superconductor line oriented in a spiral fashion, or a high temperature superconductor self-resonant planar coil comprised of a high temperature superconductor line oriented in a spiral fashion; and provides a process for the production of such HTS devices.

The process involves depositing an epitaxial layer of $CeO_2$ on a single crystal substrate, and forming an epitaxial high temperature superconducting film on the $CeO_2$ layer. The process also involves a step of forming from the HTS film one or more superconductor lines oriented in a spiral fashion. In one embodiment, the process involves:

(a) depositing an epitaxial layer of $CeO_2$ on a single crystal substrate;
(b) forming an epitaxial high temperature superconducting film on the $CeO_2$ layer;
(c) coating the high temperature superconducting film with a photoresist;
(d) exposing the photoresist to ultraviolet light through a photomask containing the mini-filter or coil design;
(e) developing the photoresist to produce the pattern of the mini-filter or coil in the photoresist;
(f) etching away the high temperature superconductor exposed when the photoresist was developed; and
(g) removing the remaining photoresist to expose the high temperature superconductor mini-filter or coil.

Preferably, the epitaxial layer of $CeO_2$ is deposited by sputter deposition while the substrate temperature is elevated. Preferably, the high temperature superconductor is etched away in step (f) using an argon beam and the remaining photoresist is removed in step (g) using oxygen plasma.

Preferably, an epitaxial layer of $CeO_2$ is deposited on both sides of the substrate and an epitaxial high temperature superconducting film is formed on the $CeO_2$ layer on both sides of the substrate. When producing a mini-filter, the high temperature superconducting film on the front side of the substrate is subsequently patterned as described above in steps (c)-(g) and the high temperature superconducting film on the back side of the substrate is used as a ground plane. The ground plane may be unpatterned or patterned. When there are superconducting layers on both sides of the substrate, both sides are coated with photoresist in step (c) above and in step (g) the remaining photoresist on the front side and the photoresist on the back side are removed. The high temperature superconducting film on the back side is coated with a conductive film such as gold to provide good ground contact. When producing a coil, the high temperature superconducting film on the front side of the substrate and on the back side of the substrate is subsequently patterned as described above in steps (c)-(g). Both sides are coated with photoresist in step (c) and in step (g) the remaining photoresist is removed.

Preferably, the substrate is selected from the group consisting of $LaAlO_3$, MgO and $Al_2O_3$.

This invention also provides a high temperature superconductor mini-filter comprising at least two self-resonant spiral resonators, each of the spiral resonators independently comprising a high temperature superconductor line oriented in a spiral fashion such that adjacent lines of the spiral resonator are spaced from each other by a gap distance and so as to provide a central opening within the spiral resonator, wherein the at least two spiral resonators are in intimate contact with an epitaxial layer of $CeO_2$ that is on a single crystal substrate. In a further embodiment, the single crystal substrate may be selected from the group consisting of $LaAlO_3$, MgO and $Al_2O_3$.

In addition, this invention provides a high temperature superconductor self-resonant planar coil comprising a high temperature superconductor line oriented in a spiral fashion such that adjacent lines of the coil are spaced from each other by a gap distance and so as to provide a central opening within the coil, wherein the coil is in intimate contact with an epitaxial layer of $CeO_2$ that is on a single crystal substrate. In a further embodiment, the single crystal substrate may be selected from the group consisting of $LaAlO_3$, MgO and $Al_2O_3$.

This invention also provides a high temperature superconductor mini-filter comprising:

a) a single crystal substrate having a front side and a back side and preferably selected from the group consisting of $LaAlO_3$, MgO and $Al_2O_3$;

b) an epitaxial layer of $CeO_2$ on both sides of the substrate;

c) at least two self-resonant spiral resonators in intimate contact with the $CeO_2$ layer on the front side of the substrate, each of the spiral resonators independently comprising a high temperature superconductor line oriented in a spiral fashion such that adjacent lines of the spiral resonator are spaced from each other by a gap distance and so as to provide a central opening within the spiral resonator;

d) at least one inter-resonator coupling mechanism;

e) an input coupling circuit comprising a transmission line with a first end thereof connected to an input connector of the mini-filter and a second end thereof coupled to a first one of the spiral resonators;

f) an output coupling circuit comprising a transmission line with a first end thereof connected to an output connector of the mini-filter and a second end thereof coupled to a last one of the spiral resonators;

g) a high temperature superconductor film disposed on the $CeO_2$ layer on the back side of the substrate as a ground plane; and h) a conductive film disposed on the high temperature superconductor film.

This invention also provides a high temperature superconductor mini-filter having a strip line form with all the features of the mini-filter described above and further comprising:

i) a superstrate having a front side and a back side, wherein the front side of the superstrate is positioned in intimate contact with the spiral resonators disposed on the front side of the substrate;

j) a high temperature superconductor film disposed on the back side of the superstrate as a ground plane; and k) a conductive film disposed on the surface of the high temperature superconductor film disposed on the back side of the superstrate.

This invention also provides a high temperature superconductor self-resonant planar coil comprising:

a) a single crystal substrate having a front side and a back side and preferably selected from the group consisting of $LaAlO_3$, MgO and $Al_2O_3$;

b) an epitaxial layer of $CeO_2$ on the front side of the substrate; and c) a high temperature superconductor line in intimate contact with the $CeO_2$ layer on the front side of the substrate, wherein the high temperature superconductor line is oriented in a spiral fashion such that adjacent lines of the spiral are spaced from each other by a gap distance and so as to provide a central opening within the spiral.

This invention also provides a high temperature superconductor self-resonant planar coil comprising:

a) a single crystal substrate having a front side and a back side and preferably selected from the group consisting of $LaAlO_3$, MgO and $Al_2O_3$;

b) an epitaxial layer of $CeO_2$ on both sides of the substrate; and c) two high temperature superconductor lines, one in intimate contact with the $CeO_2$ layer on the front side of the substrate and one in intimate contact with the $CeO_2$ layer on the back side of the substrate, wherein each high temperature superconductor line is oriented in a spiral fashion such that adjacent lines of the spiral are spaced from each other by a gap distance and so as to provide a central opening within the spiral.

The high temperature superconductor used to form the high temperature superconductor line for all of the at least two improved self-resonant spiral resonators, for the high temperature superconductor films and for the high temperature superconductor coils is preferably selected from the group consisting of $YBa_2Cu_3O_7$, $Tl_2Ba_2CaCu_2O_8$, $TlBa_2Ca_2Cu_3O_9$, $(TlPb)Sr_2CaCu_2O_7$ and $(TlPb)Sr_2Ca_2Cu_3O_9$. Most preferably, the high temperature superconductor is $Tl_2Ba_2CaCu_2O_8$ or $YBa_2Cu_3O_7$.

The conductive films disposed on the surfaces of the high temperature superconductor ground plane films in the mini-filters described above can serve as contacts to the cases of the mini-filters. Preferably, these conductive films are gold films.

DETAILED DESCRIPTION OF THE PREFERRED EMBODIMENTS

Figure 1:
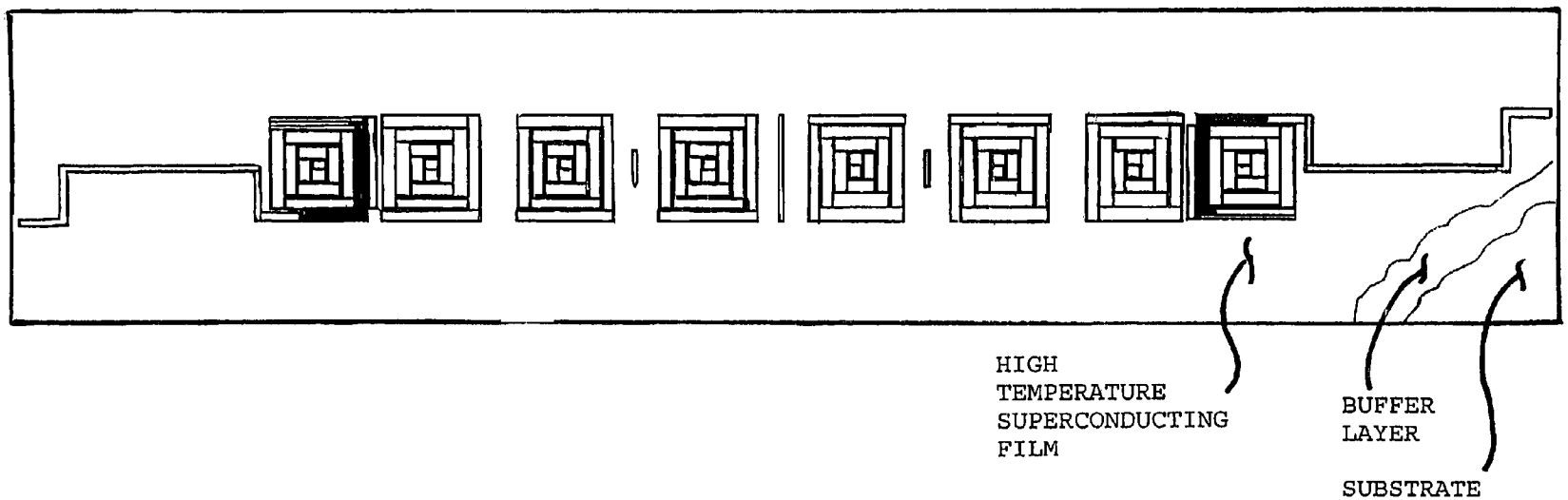
FIG. 1 shows the microstrip 8-pole filter configuration used in the example and the comparison experiment, with portions broken away for clarity of illustrating the structure underlying the high temperature superconductor layer.

This invention provides a process for producing high temperature superconductor mini-filters or coils with high yield without concern for variations in substrates from batch to batch or from different suppliers. The deposition of an epitaxial buffer layer of $CeO_2$ on the substrate before the formation of the high temperature superconductor layer and the making of the mini-filter or coil will have different effects on the mini-filter or coil yield depending on the nature of the substrate. However, the routine use of the $CeO_2$ buffer layer reduces the uncertainty in the mini-filter or coil yield and provides consistently high mini-filter or coil yield. The use of a $CeO_2$ buffer layer will have similar beneficial advantages when producing other high temperature superconductor devices.

As used herein, "yield" means the percentage of the mini-filters or coils produced with acceptable performance characteristics.

The single crystal substrate is preferably selected from the group consisting of $LaAlO_3$, MgO and $Al_2O_3$ and $LaAlO_3$ is especially preferred. The surface of the substrate on which the epitaxial buffer layer of $CeO_2$ is to be deposited should be clean and polished. The epitaxial $CeO_2$ layer can be deposited by various known methods but off-axis sputter deposition is preferred and the substrate temperature should be elevated, i. e., about 600-900° C., preferably about 700-800° C., during the deposition.

The high temperature superconductor used to form the HTS lines for all of the self-resonant spiral resonators is preferably selected from the group consisting of $YBa_2Cu_3O_7$, $Tl_2Ba_2CaCu_2O_8$, $TlBa_2Ca_2Cu_3O_9$, (TlPb) $Sr_2CaCu_2O_7$ and (TlPb)$Sr_2Ca_2Cu_3O_9$. Most preferably, the high temperature superconductor is $Tl_2Ba_2CaCu_2O_8$ or $YBa_2Cu_3O_7$. Various methods are known for depositing each of these high temperature superconductors and any of these methods that result in an epitaxial layer of the HTS on the $CeO_2$ layer can be used.

The use of photoresists to produce patterned elements is well known in the electronics industry and these standard methods can be used to make the patterned mini-filter or coil configuration from the unpatterned HTS layer. Preferably, the HTS to be removed is etched away using an argon beam and the photoresist covering the HTS filter or coil is removed using oxygen plasma.

The high temperature superconductor mini-filter made by this process is comprised of at least two self-resonant spiral resonators, each of the spiral resonators independently comprising a high temperature superconductor line oriented in a spiral fashion such that adjacent lines of the spiral resonator are spaced from each other by a gap distance and so as to provide a central opening within the spiral resonator. Preferably, the gap distance is less than the width of the high temperature superconductor line and the dimensions of the central opening are approximately equal to the gap distance. A conductive tuning pad may be placed in the central opening to fine tune the frequency of the spiral resonator. This tuning pad can be a high temperature superconductor.

Preferably, all the self-resonant spiral resonators in a mini-filter have an identical shape, i.e., rectangular, rectangular with rounded corners, polygonal with more than four sides or circular.

The input and output coupling circuits of the mini-filter have two basic configurations:

1. Parallel lines configuration which comprises a transmission line with a first end thereof connected to an input connector of the filter via a gold pad on top of the line, and a second end thereof is extended to be close by and in parallel with the spiral line of the first spiral resonator (for the input circuit) or the last spiral resonator (for the output circuit) to provide the input or output couplings for the filter;
2. Inserted line configuration which comprises a transmission line with a first end thereof connected to an input connector of the filter via a gold pad on top of the line, and a second end thereof is extended to be inserted into the split spiral line of the first spiral resonator (for the input circuit) or the last spiral resonator (for the output circuit) to provide the input or output couplings for the filter.

The inter-resonator couplings between adjacent spiral resonators in the mini-filter are provided by the overlapping of the electromagnetic fields at the edges of the adjacent spiral resonators. In addition, HTS lines can be provided between the spiral resonators to increase coupling and adjust the frequency of the mini-filter.

The mini-filters of this invention can be in the microstrip line form with one substrate and one ground plane; they also can be in the strip line form with a substrate, a superstrate and two ground planes.

As the number of self-resonant spiral resonators in the mini-filter increases, the difficulty of obtaining high yields of mini-filters also increases and the advantage of using the process of this invention to produce the mini-filters increases.

The use of a $CeO_2$ buffer layer will have similar beneficial advantages when producing high temperature superconductor self-resonant planar coils. The planar coil, i.e., surface coil, can have a HTS coil configuration on just one side of the substrate or essentially identical HTS coil configurations on both sides of the substrate. The coil configuration is comprised of a high temperature superconductor line oriented in a spiral fashion. Adjacent lines of the spiral are spaced from each other by a gap distance and provide a central opening within the spiral. The width of the HTS line can be uniform or can vary along the length of the spiral. Similarly, the gap distance can be uniform or can vary along the length of the spiral.

An HTS mini-filter according to this invention may be used in a variety of electronic devices such as a cryogenic receiver front end. An HTS coil according to this invention may also be used in a variety of electronic devices such as a nuclear quadrupole resonance ("NQR") detection system. An NQR detection system can be used to detect the presence of chemical compounds for any purpose, but is particularly useful for detecting the presence of controlled substances such as explosives, drugs or contraband of any kind. Such an NQR detection system could be usefully incorporated into a safety system, a security system, or a law enforcement screening system. For example, these systems can be used to scan persons and their clothing, carry-on articles, luggage, cargo, mail and/or vehicles. They can also be used to monitor quality control, to monitor air or water quality, and to detect biological materials.

Example of the Invention and Comparative Experiment

This example in which seventeen 8-pole mini-filters, each with the design shown in FIG. 1, were produced using double-sided $Tl_2Ba_2CaCu_2O_8$ on a $CeO_2$ buffered $LaAlO_3$ substrate illustrates the high yield obtainable using the process of this invention. As indicated in FIG. 1 a portion of the high temperature superconductor layer is broken away to expose the buffer layer, while a portion of the buffer layer is also broken away to expose the substrate.

A clean, polished single crystal $LaAlO_3$ substrate was obtained from MTI Corporation, Richmond, Calif. An epitaxial $CeO_2$ buffer layer was grown on both sides of the substrate by off-axis sputter deposition with the substrate temperature held in the range of about 700- 800° C.

Off-axis magnetron sputtering of a Ba:Ca:Cu oxide target was used to deposit, at room temperature (about 20° C.), an amorphous precursor Ba:Ca:Cu oxide film onto the $CeO_2$ layer on both sides of the substrate. This amorphous precursor Ba:Ca:Cu oxide film was about 550 nm thick and had a stoichiometry of about 2:1:2. The precursor film was then thallinated by annealing it in air for about 45 minutes at about 850° C. in the presence of a powder mixture of $Tl_2Ba_2Ca_2Cu_3O_{10}$ and $Tl_2O_3$. When this powder mixture is heated, $Tl_2O$ evolves from the powder mixture, diffuses to the precursor film and reacts with it to form the desired $Tl_2Ba_2CaCu_2O_8$ phase. Standard X-ray diffraction measurements show that the $Tl_2Ba_2CaCu_2O_8$ film has an in-plane alignment which is determined by the underlying $CeO_2$ buffer layer with the [100] crystal axis of the $Tl_2Ba_2CaCu_2O_8$ film rotated by 45° with respect to the [100] crystal axis of the $CeO_2$ buffer layer.

The $Tl_2Ba_2CaCu_2O_8$ film surface was then cleaned using an argon ion beam. A gold film was evaporated onto and completely covered the unpatterned $Tl_2Ba_2CaCu_2O_8$ film on the back side of the substrate. Gold contact pads were evaporated through a shadow mask onto the front side $Tl_2Ba_2CaCu_2O_8$ film surface. The sample was then coated with photoresist on both sides and baked. A filter design photomask containing the design for three mini-filters, each with the design shown in FIG. 1, was prepared. The input and output coupling circuits have the inserted line configuraton. The gap between the HTS lines of the resonators was 44 μm. The width of the HTS lines of the resonators varied from 220 μm to 308 μm. The design of the resonators and inter-resonator couplings was optimized using Sonnet EM software, obtained from Sonnet Software, Inc, Liverpool, N.Y. 13088. The filter design photomask was then placed on the photoresist covering the $Tl_2Ba_2CaCu_2O_8$ film on the front side of the substrate and exposed to ultraviolet light. The resist was then developed and the portion of the $Tl_2Ba_2CaCu_2O_8$ film exposed when the resist was developed was etched away by argon beam etching. The remaining photoresist layer on the front and back sides of the substrate was then removed by an oxygen plasma. A dicing saw was then used to section the three individual mini-filters.

Figure 2:
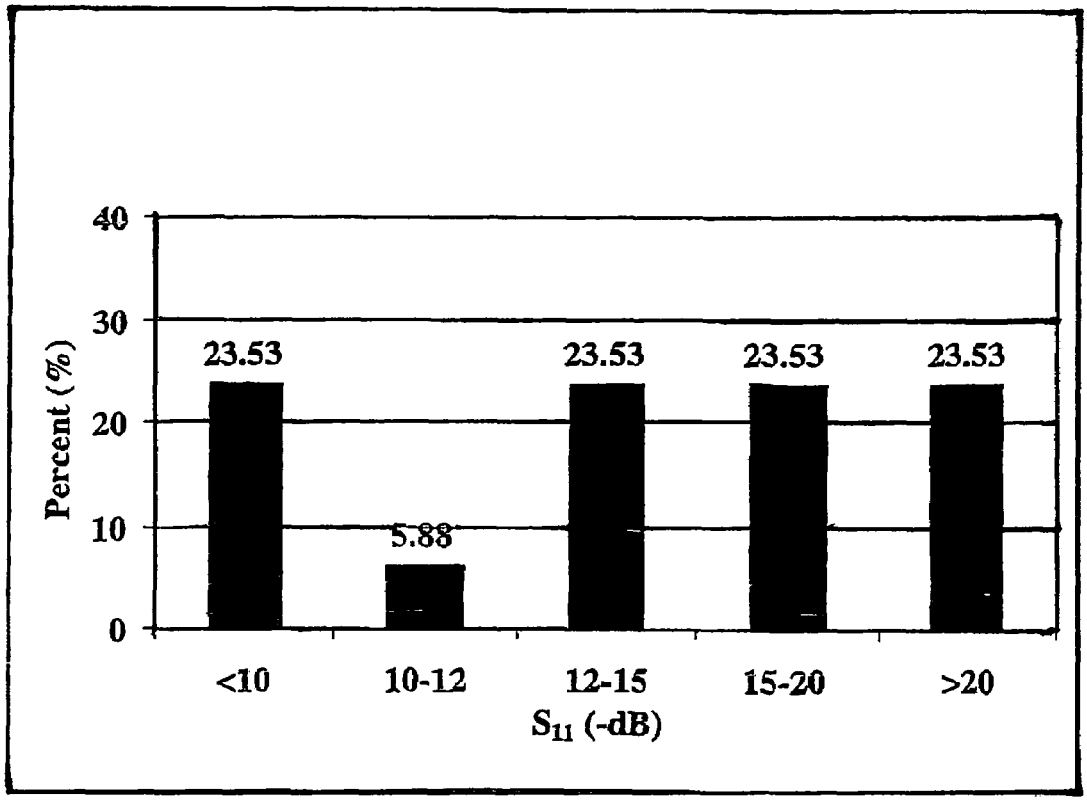
FIG. 2 shows the distribution of the reflection coefficient $S_{11}$ (in -dB) obtained for 8-pole mini-filters made using a $Tl_2Ba_2CaCu_2O_8$ film on $LaAlO_3$ with a $CeO_2$ layer.

17 mini-filters prepared as described above were obtained for analysis. $S_{11}$ is the magnitude of the reflection coefficient from the input port. $S_{11}$ is an important parameter for practical applications of these mini-filters and is used here to characterize the mini-filters produced. $S_{11}$ outside the band-pass region is nearly 1, i.e., about 0 dB. $S_{11}$ in the band-pass region should be as small as possible. $S_{11}$ was measured for each of the 17 mini-filters. The percentage of mini-filters with an $S_{11}$ in the band-pass region between 0 and −10 dB, between −10 db and −12 dB, between −12 db and −15 dB, between −15 dB and −20 dB and smaller than −20 dB are shown in FIG. 2. Over 70% of the mini-filters have an $S_{11}$ in the band-pass region smaller than −12 dB.

Figure 3:
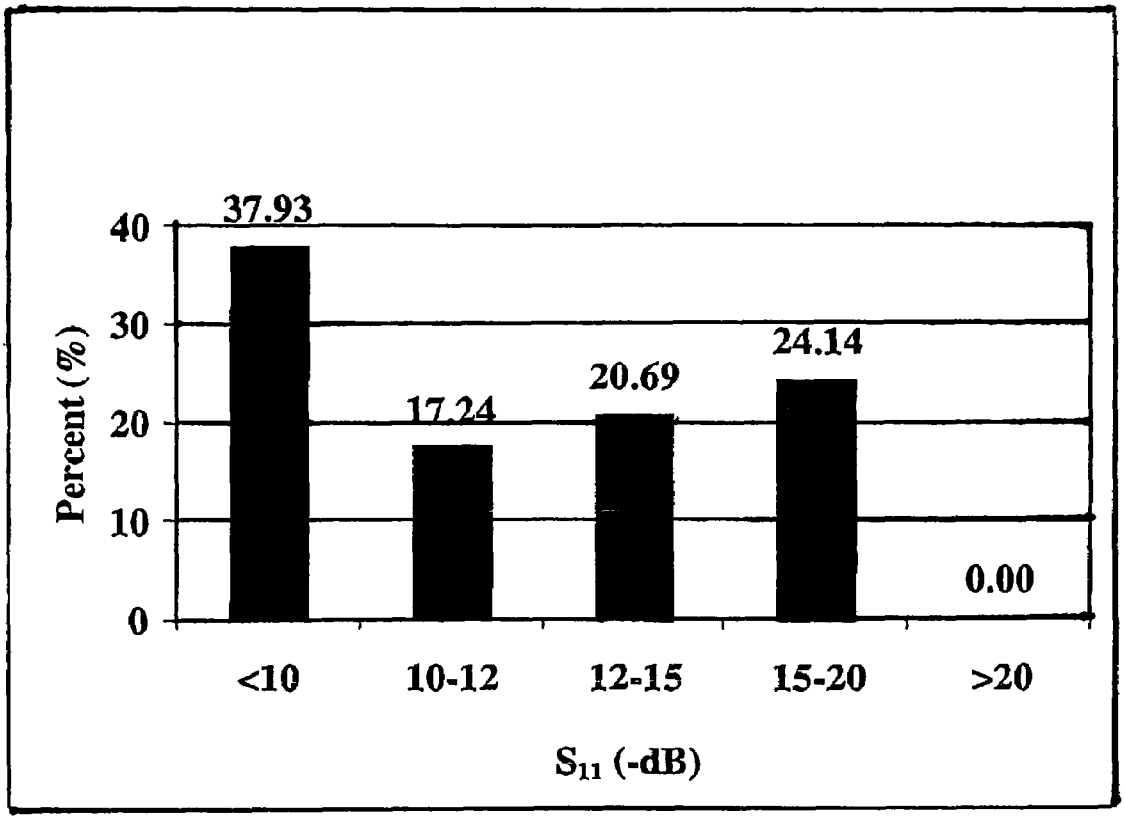
FIG. 3 shows the distribution of the reflection coefficient $S_{11}$ (in -dB) obtained for 8-pole mini-filters made using a $Tl_2Ba_2CaCu_2O_8$ film on $LaAlO_3$ without a $CeO_2$ layer.

A comparative experiment was carried out preparing the mini-filters essentially as described above except for the omission of the deposition of the $CeO_2$ layer. 29 mini-filters were obtained for analysis. The percentage of mini-filters with an $S_{11}$ in the band-pass region between 0 and −10 dB, between −10 db and −12 dB, between −12 db and −15 dB, between −15 dB and −20 dB and smaller than −20 dB are shown in FIG. 3. Less than 45% of the mini-filters have an $S_{11}$ in the band-pass region smaller than −12 dB. This compares with the over 70% in that range for the mini-filters of the invention. The $CeO_2$ buffer layer isolates and protects the filter from the influence of and interaction with the $LaAlO_3$ substrate. The $CeO_2$ buffer layer results in the high yield necessary for a practical process.

Where an apparatus or method of this invention is stated or described as comprising, including, containing, having, being composed of or being constituted by certain components or steps, it is to be understood, unless the statement or description explicitly provides to the contrary, that one or more components or steps other than those explicitly stated or described may be present in the apparatus or method. In an alternative embodiment, however, the apparatus or method of this invention may be stated or described as consisting essentially of certain components or steps, in which embodiment components or steps that would materially alter the principle of operation or the distinguishing characteristics of the apparatus or method would not be present therein. In a further alternative embodiment, the apparatus or method of this invention may be stated or described as consisting of certain components or steps, in which embodiment components or steps other than those as stated would not be present therein.

Where the indefinite article "a" or "an" is used with respect to a statement or description of the presence of a component in an apparatus, or a step in a method, of this invention, it is to be understood, unless the statement or description explicitly provides to the contrary, that the use of such indefinite article does not limit the presence of the component in the apparatus, or of the step in the method, to one in number.

What is claimed is:

1. A process for producing high temperature superconductor mini-filters, spiral resonators or self-resonant coils on batches of single crystal substrates, each high temperature superconductor device comprised of a high temperature superconductor line oriented in a spiral fashion, the process comprising, for each batch:

(a) depositing an epitaxial layer of $CeO_2$ on a single crystal substrate by off-axis sputter deposition, the substrate temperature being maintained at a temperature in the range of about 700-800° C. during the deposition, the substrate for any one batch being selected from the group consisting of $LaAlO_3$, MgO and $Al_2O_3$;

(b) forming an epitaxial high temperature superconducting film on the layer of $CeO_2$;

(c) coating the high temperature superconducting film with a photoresist;

(d) exposing the photoresist to ultraviolet light through a photomask containing a pattern for one or more devices wherein each device contains a spiral line;

(e) developing the photoresist to produce the pattern;

(f) using an argon beam, etching away the high temperature superconductor exposed when the photoresist was developed; and (g) using an oxygen plasma, removing the remaining photoresist to expose the one or more high temperature superconductor devices, the presence of the epitaxial layer of $CeO_2$ between the single crystal substrate and the high temperature superconducting film providing a buffer layer between the film and the substrate in each batch, whereby a high percentage of the mini-filters, spiral resonators or self-resonant coils produced in each batch exhibit acceptable performance properties despite the presence of variations in substrates from batch to batch.

2. The process of claim 1 wherein the substrate is $LaAlO_3$.

3. The process of claim 1 wherein each device is a high temperature superconductor mini-filter, wherein the yield is at least seventy percent (70%).

4. The process of claim 1 wherein each device is a high temperature superconductor coil.

* * * * *